United States Patent [19]

Brant

[11] Patent Number: 5,040,750

[45] Date of Patent: Aug. 20, 1991

[54] EAVESTROUGH HOOK AND LEAF GUARD

[75] Inventor: Anthony W. Brant, Barrie, Canada

[73] Assignee: GSW Inc., Barrie, Canada

[21] Appl. No.: 520,655

[22] Filed: May 1, 1990

[51] Int. Cl.[5] ..... E04D 13/00

[52] U.S. Cl. ..... 248/48.2; 52/11

[58] Field of Search ..... 248/48.2, 48.1, 300, 248/316.8, 201; 52/11, 12, 94, 96

[56] References Cited

U.S. PATENT DOCUMENTS

| | | | |
|---|---|---|---|
| 891,406 | 6/1908 | Cassens | 248/48.2 X |
| 2,636,458 | 4/1953 | Harris | 52/12 X |
| 3,022,029 | 2/1962 | Blayden | 248/48.2 |
| 3,296,749 | 1/1967 | Cotter | 248/48.2 X |
| 4,553,356 | 11/1985 | Pepper | 52/12 X |
| 4,581,857 | 4/1986 | Harbom | 248/48.2 X |
| 4,632,342 | 12/1986 | Skinner | 248/48.2 |
| 4,776,544 | 10/1988 | Williams | 52/11 X |
| 4,901,954 | 2/1990 | Fairgrieve et al. | 248/48.2 |

*Primary Examiner*—Karen J. Chotkowski

[57] ABSTRACT

The eavestroughing system uses hidden hooks in combination with a particular evestrough which allows the effective placement of a leaf screen within the eavestroughing system. The leaf screen is engaged either side thereof in a simple manner, allowing convenient ease of insertion of the screen within the eavestroughing system and in a predetermined orientation. The eavestrough section cooperates with the hanger to provide support for the screen adjacent a forward edge of the screen and also serves to hide the forward edge of the screen within the eavestrough section. The preferred orientation of the screen advantageously is disposed at a downwardly extending angle to the forward edge of the eavestrough to encourage the movement of debris across the screen towards the forward edge where it can easily be removed by the end user and/or removed by natural causes. This natural tendency to move the debris across the screen reduces accumulation of debris on the screen. Furthermore, the particular support arrangement has higher support adjacent the forward edge and therefore, if there is any accumulation, there is better support for the screen at this position. The present system provides a simple and convenient arrangement for a fully integrated plastic eavestroughing system.

20 Claims, 1 Drawing Sheet

EAVESTROUGH HOOK AND LEAF GUARD

FIELD OF THE INVENTION

The present invention relates to eavestroughing systems and particularly eavestrough hangers for such eavestroughing systems wherein the hangers include leaf screen securing means.

BACKGROUND OF THE INVENTION

A number of eavestrough systems are now known which use what is referred to as a hidden hook for suspending of the eavestrough below the roof eaves. Examples of such systems can be appreciated from the following references: U.S. Pat. No. 4,581,857, U.S. Pat. No. 4,632,342, and U.S. Pat. No. 3,022,029.

Provision for leaf securing means in eavestrough systems are also known according to U.S. Pat. No. 4,553,356 and U.S. Pat. 4,553,357 which use an eavestrough wherein the leaf screen is secured by means of slots placed in the eavestrough. The eavestrough of these patents uses a hook which is designed to be placed above the exterior of the eavestrough.

A hidden eavestrough hanger for suspending of the eavestrough has been described in commonly assigned U.S. Pat. Application Ser. No. 230,420 filed Aug. 10, 1988, now U.S. Pat. No 4,901,954, Feb. 20, 1990.

SUMMARY OF THE INVENTION

An eavestrough hanger according to the present invention comprises a base and a forwardly extending cantilevered arm extending from the base. The arm includes a locking means at a free end thereof and an opposite locking means at a lower edge of the arm spaced from but adjacent from the base for attachment of a eavestrough section. The base extends above the arm and includes leaf screen securing means above the arm. The arm includes opposite leaf screen securing means above the locking means.

According to an aspect of the invention, the leaf securing means on the base is a forwardly opening slot and leaf securing means on the arm is a rear opening slot.

According to a further aspect of the invention, the arm is of an inverted T-shape in cross section and joins the base of the flange perpendicular to the inverted T-section and generally centered thereon enclosing the inverted T-section.

The eavestrough holder of the present invention provides for a secure means for holding leaf screens in an eavestroughing system.

BRIEF DESCRIPTION OF THE DRAWINGS

The above as well as other advantages of the present invention will be appreciated from drawings which illustrate a preferred embodiment of the invention in which.

DETAILED DESCRIPTION OF THE PREFERRED EMBODIMENTS

Figure 1:
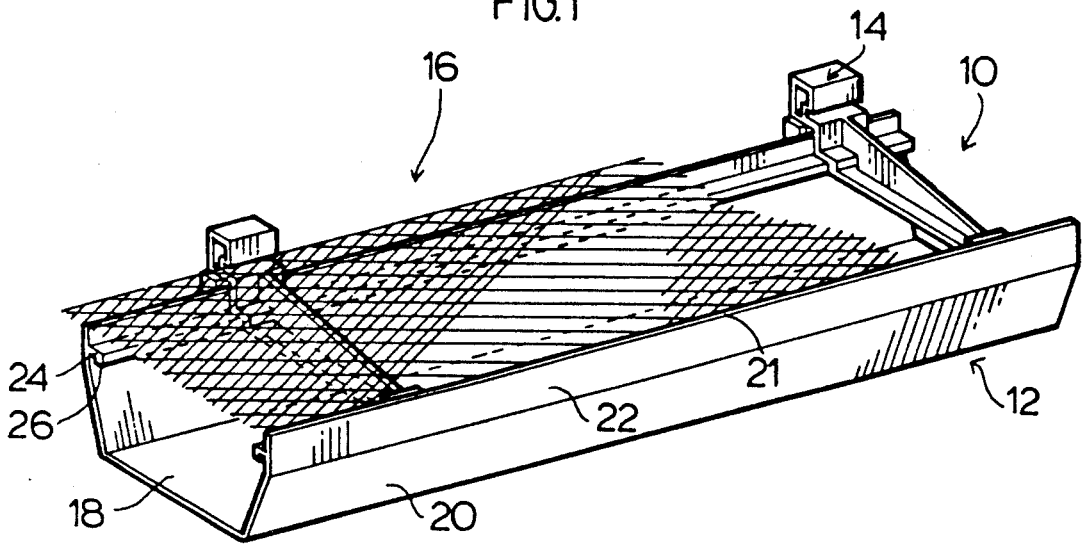
FIG. 1 is a partial perspective view showing eavestroughing system of the present invention.
Figure 2:
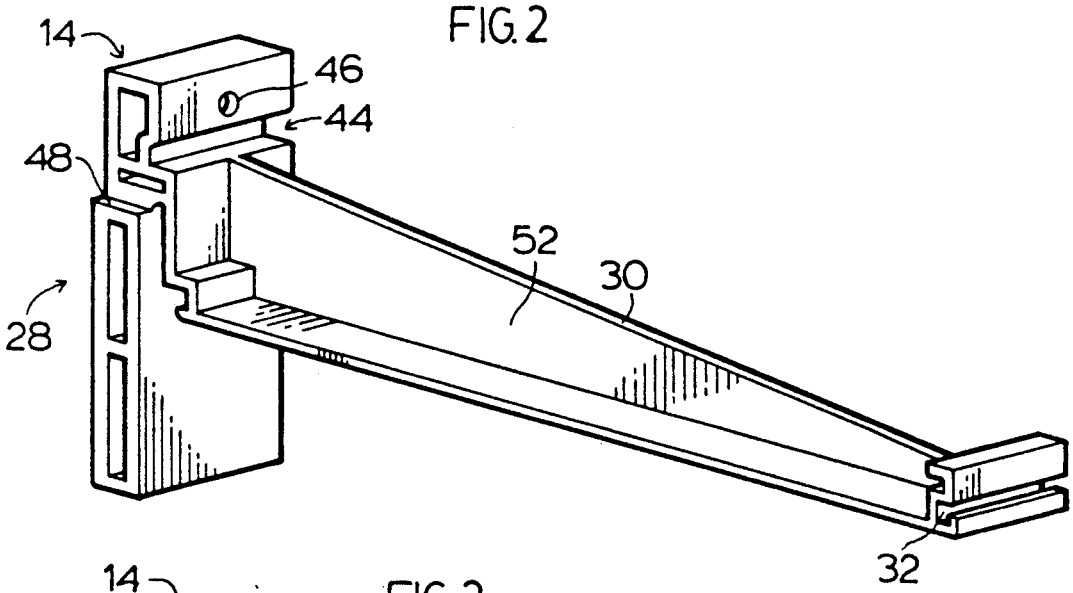
FIG. 2 is a perspective view of the eavestrough hanger of FIG. 1.
Figure 3:
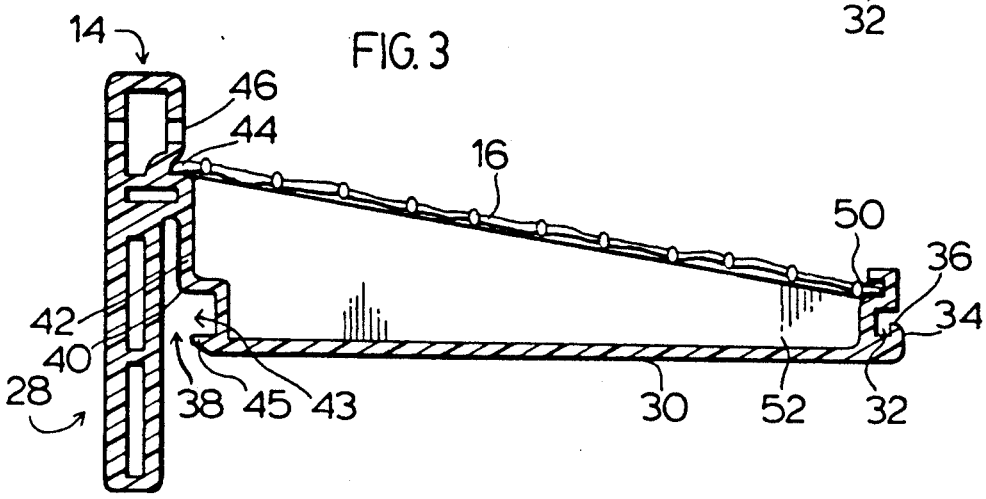
FIG. 3 is a side view showing the securement of the leaf screen in the eavestrough hanger.

The eavestrough system of the present invention is illustrated in FIG. 1 generally indicated by the numeral

10. The system comprises eavestrough section 12, eavestrough hanger 14 and leaf screen 16. Eavestrough section 12 is preferably of a symmetrical section having a generally flat base 18 and outwardly angled walls 20, each of which terminate in a short vertical section 22. The vertical sections 22 each include a locking flange 24 having a downwardly directed lip 26 at the free end of the locking flange. Further details on the eavestrough section and eavestrough hanger are shown in commonly assigned U.S. Pat. Application Ser. No. 230,420 filed Aug. 10, 1988, now U.S. Pat. No. 4,901,954, Feb. 20, 1990.

The eavestrough hanger 14 has a cored base 28 which is essentially a rectangular box with certain interior partitions and open at the sides. The hanger 14 includes a forwardly extending cantilevered arm 30 of an inverted T-shape section. The arm 30 at the free end thereof includes a front opening slot 32 for receiving one of the locking flanges 24 by means of which the eavestrough is partially hung below the eavestrough hanger 14. Front opening slot 32 includes an angled camming surface 34 and a lip 36, sized to provide an interference fit with the locking flange 24 and downwardly directed lip 26. There is a similar interference type fit provided at the opposite opening slot 38 provided at the lower edge of arm 30. Again, the locking flange 24 of the eavestrough is forced through a slot, in this case through a slot 38 such that the vertical section 22 extends into the upwardly extending portion 40 of slot 38 which is eventually limited by the rectangular section 42 with the appropriate locking flange located in the horizontal extending portion 43 of slot 38. This horizontal extending portion 43 includes a lip 45 at the entrance thereof to provide a lock with the cooperating lip 26 of the locking flange 24. These parts cooperate to provide a two part interference locking arrangement.

The cored base 28 extends above the cantilevered arm 30 and defines in an upper region above the vertical section 52 of the cantilevered arm 30 a leaf screen securing means which is a slot 44. Cored base 28 above the leaf screen securing means 44 has a securing port 46 through which a screw may be inserted to effect securement of the eavestrough hanger 14. The hanger 14 also includes alignment recesses 48 provided at the rear surface of the base 28 which are used in properly placing the eavestrough hanger at the required distance below the eaves of the roof. The eavestrough hanger 14 at the end of the cantilevered arm 30 includes a leaf securing means which is a slot 50 located above the front opening slot. Slot 50 is rearwardly facing and is provided above the vertical section 52 of the cantilevered arm 30.

In assembling the eavestrough system of the present invention, several eavestrough hangers 14 are placed in the properly spaced positions on the fascia board the required distance below the eaves of the roof. Thereafter, leaf screen 16 is secured to the hangers 14 by placing the opposite sides of the leaf screen into the leaf screen securing slots 44 and 50 at the opposite ends of the hanger. The eavestrough section 12 is then attached to the hangers 14 by forcing one locking connection 24 into the front opening slot 32 and thereafter forcing the eavestrough through slot 38 such that the vertical section 22 extends into the upwardly extending portion of slot 38 until lip 42 and lip 26 cooperate to lock the eavestrough section 12 into the eavestrough hanger 14.

Slot 50 is located below the upper edge 21 of the eavestrough 12, effectively hiding the front edge of the leaf screen. Furthermore, between hangers, the front edge of the leaf screen 16 is supported on the upper surface of locking flange 24. Screen 16 is predisposed at a downwardly extending angle encouraging movement of leafs and other large debris to the front edge of the eavestrough. Each hanger 14 supports the screen 16 atop the 'T' shaped cantilevered arm 30 which also assists in maintaining the desired orientation of the screen 16. The provision of slots 44 and 50, which extend across the width of the hanger, also provide support in the length of the screen 16 whereby the screen remains in the desired position. The predisposed angle of the screen reduces the probability of upward removal of the front edge of the screen which is opposed by slot 50. In place, the screen 16 is generally planar as opposed to a bowed configuration common in the prior art. The grid type network of the screen, preferably made of plastic, acts as ribs which have a bias encouraging a planar orientation of the screen utilized in the present system.

The present arrangement for maintaining of a leaf screen advantageously uses the hanger for both support and fastening by using simple and convenient slots in combination with a particular eavestrough section. The eavestrough section has a locking flange extending interiorly below the upper edge of the eavestrough section to effectively support the leaf screen along the forward edge and at a downwardly extending angle across the eavestrough section. This orientation encourages debris to move to the forward edge of the eavestrough where it is more likely removed by natural causes or by the end user. The slots also allow the leaf screen to be bowed therebetween if desired by using an oversized screen. In most cases the generally planar leaf screen is preferred as it is more difficult to accidently remove and is less visible.

The leaf screen securing means on the eavestrough hanger also securely holds the leaf screen in place and greatly reduces the tendency of the leaf screen to be blown away from the eavestrough system in high winds and particularly when debris is frozen to the leaf screen. Any weight on the leaf screen encourages engagement of the leaf screen in the slots of the eavestrough hooks. The leaf screen securing means at the end of the arm being below the upper edge of the eavestrough results in a more aesthetically pleasing finished appearance of the eavestroughing system as both the hook and leaf screen are hidden.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privelege is claimed are as follows:

1. An eavestrough hanger comprising a base and a forwardly extending cantilevered arm extending from said base;

said cantilevered arm including a locking means at a free end thereof and an opposite locking means at a lower edge of said cantilevered arm spaced from but adjacent said base for engaging an eavestrough, said base extending above said cantilevered arm and including a leaf screen securing means above said cantilevered arm; and said cantilevered arm including an opposite leaf screen securing means above said locking means located at a free end of said cantilevered arm.

2. An eavestrough hanger as claimed in claim 1 wherein said leaf screen securing means on said arm at the free end thereof is a rear opening slot.

3. An eavestrough hanger as claimed in claim 2 wherein said leaf securing means on said base is a forwardly opening slot.

4. An eavestrough hanger as claimed in claim 3 wherein said arm is of an inverted 'T' shape in cross section.

5. An eavestrough hanger as claimed in claim 4 wherein said base and said arm join at a flange perpendicular to said inverted 'T' shape in cross section of said arm and generally centered thereon and closing said inverted 'T' shape in cross section of said arm at one end of said arm.

6. An eavestrough hanger as claimed in claim 5 wherein said base is a cored base of a generally box-like configuration with a plurality of interior partitions, said box-like configuration being open at sides of said box-like configuration with a number of said partitions visible at the open sides of said box-like configuration.

7. An eavestrough hanger as claimed in claim 6 including a rectangular extension joining said flange and said base.

8. An eavestrough hanger as claimed in claim 7 wherein said base includes a securing port above said leaf screen securing means associated with said base for fastening of said hanger.

9. An eavestrough hanger as claimed in claim 8 wherein said base at a point of junction of said base and said flange has two spaced members which are generally at right angles to said flange and which join said arm and said base, said two spaced members cooperating to provide sufficient rigidity between said base and said arm, such that deflection of said arm relative to said base during normal use in an eavestrough system is not significant.

10. In an eavestroughing system, a plurality of aligned and supported eavestrough hangers, a length of extruded eavestroughing and a length of leaf screen;

said eavestroughing comprising a generally symmetrical cross section with a generally flat base having outwardly angled walls either side of said base with a vertical section secured to each outwardly angled wall, each vertical section including inwardly directed locking flanges below an upper edge of said vertical section, each locking flange including one part of a two-part locking arrangement;

each eavestrough hanger comprising a base and a forwardly extending cantilevered arm extending from said base, said arm including a front opening locking means at a free end thereof and an opposite locking means at a lower edge of said arm spaced from but adjacent said base;

said front opening locking means and said opposite locking means each including the second part of said two part locking system, said locking flanges of said eavestroughing being received in said front opening locking means and said opposite locking means of said aligned and supported eavestrough hangers to support said eavestroughing;

said base of each eavestrough hanger including leaf screen securing means above said arm and said arm including opposite leaf screen securing means above said front opening locking means;

said leaf screen having opposite sides received in said leaf screen securing means on said base and said arm to support said leaf screen when received in said aligned and supported eavestrough hangers.

11. In an eavestroughing system as claimed in claim 10 wherein said leaf screen securing means on said arm of each eavestrough hanger is a rear opening slot.

12. In an eavestroughing system as claimed in claim 11 wherein said leaf screen securing means on said base one each eavestrough hanger is a forwardly opening slot.

13. In an eavestroughing system as claimed in claim 10 wherein said arm of each eavestrough hanger is of an inverted 'T' shape in cross section.

14. In combination a plurality of aligned and supported eavestrough hanger, a length of eavestrough, and a leaf screen;

each eavestrough hanger comprising a base and a forwardly extending cantilevered arm extending from said base, said arm including a front opening locking means at a free end thereof and an opposite locking means at a lower edge of said arm spaced from but adjacent said base for receiving locking flanges of said section of eavestrough, and leaf screen securing means generally at either end of said cantilevered arm;

said section of eavestrough including below an upper edge thereof inward directed locking flanges extending the length of the eavestrough section which are received in said front opening locking means and said opposite lock means of each eavestrough hanger;

said leaf screen being received in said leaf screen support means of each hanger and supported across said eavestrough by said cantilevered arm and at the forward edge of said eavestrough section by the adjacent locking flange.

15. In combination as claimed in claim 14 wherein said cantilevered arm angles downwardly and said leaf screen angles downwardly towards a forward edge of said eavestrough section.

16. In combination as claimed in claim 15 wherein said leaf screen securing means of each eavestrough hanger are oppositely opening generally horizontal slots provided either end of said cantilevered arm.

17. In combination as claimed in claim 16 wherein said leaf screen is generally planar.

18. In a plastic eavestroughing system having a section of eavestrough, hidden hooks and a leaf screen, said leaf screen closing an open top of said section of eavestrough, said leaf screen being supported across said section of eavestrough by an upper surface of said hidden hooks and at a forward edge of said section of eavestrough by an inwardly extending flange of said section of eavestrough.

19. In a plastic eavestroughing system as claimed in claim 18 wherein said inwardly extending flange of said section of eavestrough also serves to secure said section of eavestrough to said hidden hooks.

20. In a plastic eavestroughing system as claimed in claim 19 wherein said leaf screen is secured to the hidden hooks by means of a pair of oppositely opening slots provided in each hidden hook with said oppositely opening slots receiving opposite sides of said leaf screen.

* * * * *